United States Patent [19]

Bradshaw et al.

[11] 4,075,524

[45] Feb. 21, 1978

[54] BRUSH SHUNT CONNECTION

[75] Inventors: Elmo F. Bradshaw; John F. Rakszawski, both of St. Marys, Pa.

[73] Assignee: Airco, Inc., Montvale, N.J.

[21] Appl. No.: 701,471

[22] Filed: July 1, 1976

[51] Int. Cl.[2] ..... H01R 39/6

[52] U.S. Cl. ..... 310/249; 252/511; 260/49

[58] Field of Search ..... 252/503, 511; 260/49; 310/248–253

[56] References Cited

U.S. PATENT DOCUMENTS

| | | | |
|---|---|---|---|
| 3,510,710 | 5/1970 | McCafferty | 310/249 |
| 3,647,751 | 3/1972 | Darsow | 260/49 |
| 3,773,720 | 11/1973 | Vogel et al. | 260/49 |

*Primary Examiner*—Donovan F. Duggan

*Attorney, Agent, or Firm*—Edmund W. Bopp; Larry R. Cassett

[57] ABSTRACT

Improved shunt connections for high current conducting carbon brushes for electrical rotating machinery utilize a tamping composition comprising finely divided granules composed of 85 to 97% by weight of graphite; and 15 to 3% by weight of a high temperature-stable resin such as polyaryl sulfone. After forming the tamped connection, a sealant is applied to the tamping composition. The sealant preferably comprises an aminofunctional silane, which improves the bond between the copper shunt and the tamping composition.

5 Claims, 3 Drawing Figures

BRUSH SHUNT CONNECTION

BACKGROUND OF THE INVENTION

This invention relates generally to carbon brushes or the like, and more specifically relates to the connection of an electrically conductive flexible lead cable to such brushes.

The commutator contact brushes utilized in electrical rotating machinery commonly comprise a block or body of carbon, graphite, metal graphite, or the like (herein generically termed "carbon"), which body is provided with flexible copper conductors or leads, usually of the stranded copper wire cable or pigtail type. These leads or "shunt connections" are secured to the carbon block by embedment. In particular, a hole of somewhat larger diameter than the shunt, is drilled into the top part of the brush, and the sides of the hole scored and rifled. The end of the shunt is then fitted into the hole to the bottom, after which a free-flowing conductive tamping powder is fed into the hole in the space surrounding the shunt and tamped to anchor the shunt to the brush. If desired, several drops of a binder or sealant, such as a phenolic resin dissolved in a suitable agent such as methanol, are applied atop the shunt connection to saturate the tamping powder in this zone, and to help seal out moisture. The sealant may then be heat cured, e.g. by application of infra-red radiation.

Further details regarding carbon brushes, and the prior art techniques for effecting connections of the type discussed, may be found in a number of references, notably including McCafferty, U.S. Pat. Nos. 3,510,710 and 3,666,688. A typical composition of the type set forth in the McCafferty patents may include a mixture of 95% pelletizable graphite powder, and 5% phenolic resin powder, which mixture is blended, compacted, and milled to an appropriate size prior to use. These compositions have found considerable acceptance as tamping compositions for use in the aforementioned environments.

Notwithstanding the generally high degree of utility of the tamping materials above discussed, it has been found that in certain high performance environments difficulties can occur. The aforementioned carbon brushes e.g. when utilized for traction motors on high horsepower locomotives or the like, are designed to carry a high electrical current, typically of the order of 125 amps or so. Thus in a typical bias cut design utilized in such environments all of the current passes through two such shunts or copper cables; these cables are of comparatively heavy construction, and may be rated for at least 60 amps. In such traction motor environments, shunt failures occur with a relatively unacceptable frequency, wherein it appears the tamping powder is jarred from the hole by vibration, after which the shunt cable becomes loose, or comes out of the hole entirely. If a sufficient number of shunts pull loose in this manner, the locomotive ground relay may trip, thus preventing the locomotive from traveling under its own power and pulling its share of railroad cars. Shunt failures of the type mentioned, have in the past frequently been attributed to the lack of sufficient tamping force, or to failure to utilize a sufficient number of tamping strokes during the tamping operation. Prior corrective action was therefore aimed at maximizing the effectiveness of the tamping operations. Despite these measures, shunt failures have not been markedly eliminated or prevented.

Continued investigation appears to indicate that shunt failures of the above type are frequently accompanied by evidence of overheating. In addition, the number of brush failures increases as accumulated locomotive mileage increases. These observations suggest that a likely failure mechanism is in fact thermal degradation of the resin in the tamping powder, due to long-term thermal cycling, e.g. up to 350° F and higher, in the presence of mechanical vibration.

In accordance with the foregoing, it may be regarded as an object of the present invention to provide an improved tamping powder composition which, when used in effecting connections to carbon brushes, provides a durable shunt connection, able to resist progressive degradation and failure in high current, high temperature environments, with consequent low probability of service failure.

It is a further object of the invention to provide a carbon brush and method for preparing same, wherein the tamped interconnection between shunt cable and brush body is so effected as to provide a durable, high strength and low resistance shunt connection; which connection further displays very low probability of service failure, especially in high current, high temperature environments.

SUMMARY OF INVENTION

Now in accordance with the present invention, the foregoing objects, and others as will become apparent in the course of the ensuing specification, are achieved by use of a granular tamping composition in which each granule comprises 85 to 97% by weight of graphite particles, together with 15 to 3% by weight of polyaryl sulfone as a resin binder. The composition is prepared by blending the graphite as a pelletizable powder, with the resin binder, together with one or more solvents for the resin. The solvents are thereafter evaporated to yield a dry residue, which is then formed into a block by pressing and thereafter milled and screened to yield a flowable granular tamping powder in which each granule is a composite of graphite and resin. The granule size is typically in the range of from about −28 mesh to +100 mesh.

In a preferable procedure in accordance with the invention, the improved composition is tamped about the previously positioned cable in the usual manner, after which a polymerizable sealant is applied, and infrared radiation or the like is utilized to effect polymerization of the sealant. While the sealant may, in one aspect of the invention, comprise the same resin present in the tamping composition, a preferable sealant comprises a silane adhesion promoter, especially one including aminofunctional groups.

BRIEF DESCRIPTION OF DRAWINGS

The invention is diagrammatically illustrated by way of example in the drawings appended hereto, in which.

DESCRIPTION OF PREFERRED EMBODIMENT

Figure 1:
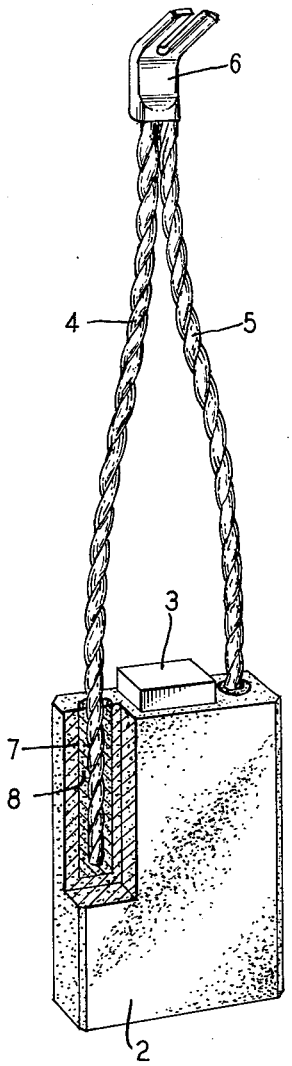
FIG. 1 is an illustration of a typical traction motor brush partly broken away to show the shunt connection.

To illustrate the field of the invention there is illustrated in FIG. 1 a typical traction motor brush consisting of a carbon block 2 which may be held in operative relation to a commutator by pressure applied to a resilient pad 3. Braided copper lead wires 4 and 5 (also called shunts or pigtails) are provided to conduct electrical current to the brush block. The lead wires 4 and 5 have a common terminal 6 for convenient connection to a suitable source of power. To more clearly illustrate the application of the invention the upper left hand corner of FIG. 1 has been broken away to expose the end of the lead wire 4 and to show the hole 7 in the brush into which the lead wire 4 is inserted and in which it is locked by the novel tamping composition 8.

In order to demonstrate the efficacy of the composition and method of the invention, a series of tests were run comparing characteristics of products based upon the invention, with products prepared by utilizing a prior art tamping composition. The prior art composition used was a standard production-type tamping composition, prepared in accordance with the procedures of the aforementioned McCafferty U.S. Pat. No. 3,666,688. The said composition, in particular, comprised a mixture of 95% pelletizable graphite powder, and 5% phenolic resin powder, the graphite and phenolic resins being blended together, compacted into plates, and milled to a 28/100 mesh size before use. This material will hereinbelow be identified as "Composition P".

The tamping powders utilized in accordance with the present invention in general utilize 85 to 97% by weight of a graphite powder, together with 15 to 3% by weight of a high temperature-stable resin, preferably a polyaryl sulfone. The polyaryl sulfone mentioned is a commercially available resin, having a softening point in excess of 600° F, the said material being available e.g. as a solvent solution, so that an intimate mixture with graphite can be produced. The resin thus utilized in the following examples is commercially available under the trade name "Polyaryl Sulfone Lacquer", from deBeers Laboratories, Inc. of Addison, Ill. The said composition comprises a 20% solids solution, i.e. a solution of the resin in a polar solvent. As is known to those familiar with the art relevant to these types of materials, polyaryl sulfone consists principally of phenyl and biphenyl groups linked by thermally stable ether and sulfone groups, the compound being distinguishable from polysulfone polymers by the absence of aliphatic groups which are liable to oxidative attack. This aromatic structure gives the cited materials excellent resistance to oxidative degradation, and is believed pertinent to its ability to retain good mechanical properties at elevated temperatures.

A tamping composition in accordance with the invention (hereinafter identified as "Composition Y") was prepared from the following raw materials:

676 grams Acheson 2301 graphite powder
169 grams Polyaryl Sulfone Lacquer, available from deBeers Laboratories, Inc., as above; and
730 grams 1-methyl 2-pyrollidinone as additional solvent The said raw materials were mixed together by hand at room temperature, after which the mixture was spread out on a tray and the solvents evaporated. Final drying was effected at 250° F for several days. The dry powder was thereafter compacted at 21 tons/sq. in. at room temperature; and the compacts were milled and screened to obtain a 28/100 mesh tamping powder.

Electrographite brush bodies having dimensions ½ inch × 1½ inches × 2 inches, were drilled and rifled with 0.234 inch diameter holes for use with stranded copper lead wires, each such lead wire consisting of seven bundles of 75 strands each of 0.005 inch copper wire. Fifteen brushes of this type were tamped with the prior art tamping powder Composition P, and fifteen were tamped with tamping powder Composition Y, prepared as described above. Both compositions tamped equally well on a conventional hand-tamping apparatus. Ten brushes of each type were then sealed. With the prior art tamping Composition P, 10 drops of sealant solution of a prior art type were used, comprising phenolic resin dissolved in methanol. With the tamping Composition Y of the present invention 10 drops of the aforementioned Polyaryl Sulfone Lacquer were used. No sealant was used on the other 10 brushes. All of the brushes were then baked for 5 hours at approximately 250° F, and then passed through an infrared heater to complete curing of the resins. In addition, four brushes tamped with Composition Y were sealed with an aminofunctional compound (silane) after infrared cure. Such a compound exhibits the ability to act as a coupling agent between organic and inorganic materials. The particular compound employed was Dow Corning Z-6020, a commercially available silane recommended for use on copper and with many resins. Dow Corning Z-6020 is N-(2-aminoethyl)-3-aminopropyltrimethoxysilane. Other suitable silanes having aminofunctional groups include gamma-aminopropyltriethoxy-silane and N-beta-(aminoethyl)-gamma-aminopropyltrimethoxy-silane. Comparison tests were conducted on the five groups of brushes as follows:

Table I

| Group | Quantity | Tamping System |
|---|---|---|
| A | 5 | Composition P, no sealant |
| B | 10 | Composition P, sealed with phenolic resin/solvent |
| C | 5 | Composition Y, no sealant |
| D | 10 | Composition Y, sealed with polyaryl sulfone/solvent |
| E | 4 | Composition Y, sealed with silane/solvent |

Brushes from each group were connected in a series circuit on a vibrating test fixture. Brushes were subjected to a cyclical load of 150 amps/in$^2$. In this test, the current is ON for 22 minutes and OFF for 22 minutes. The vibration is ON continuously, and constant air flow from an auxiliary blower is maintained. When the current is ON the brush surface temperatures near the shunt measure 300° to 500° F. This wide range is attributed in part to differences in connection resistance, and also to non-uniform air flow over the brushes. During the OFF period brushes returned to room temperature. The total test duration was 360 hours, although some specimens were tested at intermediate times.

Connection strengths were determined by clamping the shunt cable in a chuck and applying a measurable torque to the brush until the connection failed in shear. Connections were found to always fail at the cable tamping powder composition interface. Apparent shear strength was calculated using a formula which relates physical constants of the system and the measured force. The shear strength thus determined is "apparent" since the calculations assumed the total longitudinal cable area within the brush is effectively bonded. Absolute values are not particularly significant; rather this technique is intended to determine relative differences between the groups.

Figure 2:
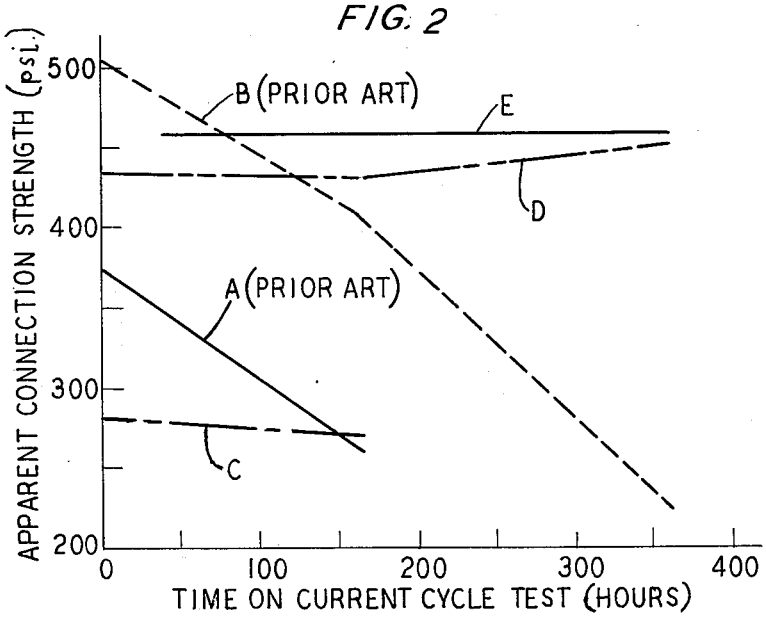
FIG. 2 is a graph depicting apparent connection strength as a function of time on current cycle test for shunt connections prepared by the invention and by prior art techniques.

In FIG. 2 there is depicted the change in connection strength as a function of time in the vibrating load test for each of several prior art brushes and for brushes of the present invention. In FIG. 2 curve A corresponds to connections produced by use of Composition P; curve B by use of Composition P + the aforementioned phenolic resin (PR)/solvent as a sealant; curve C by use of Composition Y; curve D by use of Composition Y + polyaryl sulfone (PS)/solvent as a sealant; and curve E by use of Composition Y + silane/solvent.

It will be noted here that the prior art tamping composition, i.e. Composition P, whether sealed or not (curves A and B), showed significant degradation in connection strength in consequence of current cycling. On the other hand, the tamping composition of the present invention, i.e. Composition Y (curves C, D and E), whether sealed or not showed no such degradation after up to 360 hours on current cycle test. Since the silane sealant of curve E was applied after infra-red cure of the tamped connection, whereas the sealants of curves B and D were applied before infra-red cure, strictly comparable strength data before start of the current cycle test (zero time) was not available for curve E and hence no such value is shown. Additional subsequent tests in which the silane sealant was applied before infra-red cure confirmed fully the values of apparent connection strength represented by curve E.

Figure 3:
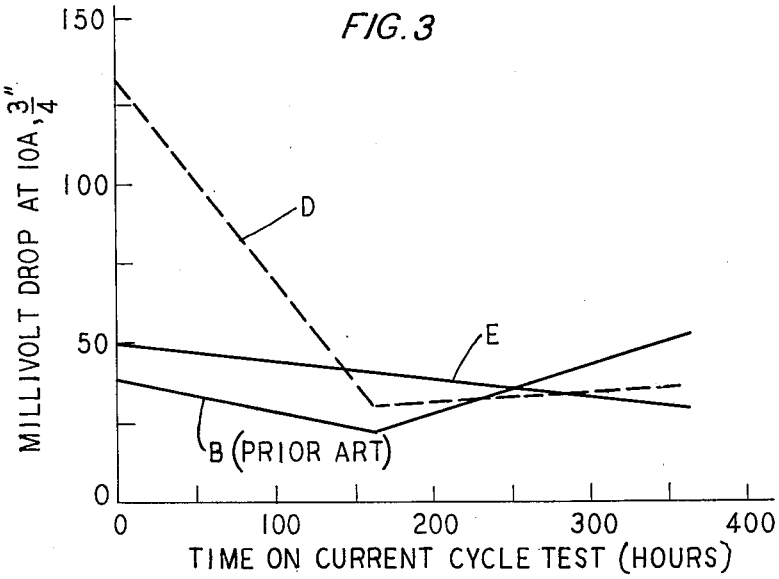
FIG. 3 is a graph of voltage drop as a function of time on current cycle test for certain of the brushes considered in developing the FIG. 2 data.

In FIG. 3 millivolt drop measurements are set forth for the systems of Groups B, D and E of FIG. 2 recorded before the current cycle test, after 160 hours on the current cycle test and after 360 hours on the current cycle test. Test conditions for MV drop data were 10 amps and ¾ inch spacing between test probes across the tamped connection position. Generally speaking it is desirable that brushes installed on a given electrodynamic machine, display a relatively constant voltage drop throughout the life of the brush. This data of FIG. 3 will be found particularly useful in connection with the data from FIG. 2; but it should be noted that the millivolt drop measurements provide no specific indication of connection integrity. The sealed tamping Composition P (curve B), is noted to exhibit a relatively constant or slightly increasing resistance with service age. The numerical data achieved in these tests are typical of the best connections yielded in typical production applications. Although initial millivolt drop of the connections based upon Composition Y sealed with polyaryl sulfone (curve D) is relatively high, after extended service it is comparable to the prior art. However, when tamping Composition Y of the present invention is sealed with a silane sealant (curve E) its initial voltage drop is relatively low, of the order of 50 millivolts and it decreases with service use.

Thus it has been found that unlike the prior art tamping composition, the shunt connection strength when employing the novel tamping Composition Y did not degrade after extended exposure to the current cycle test whether or not sealed. When sealed with polyaryl sulfone it exhibited a high initial strength as well as final strength. However, the initial voltage drop was relatively high. Composition Y, when sealed with the silane sealant, developed approximately the same high strength as when sealed with polyaryl sulfone while exhibiting low electrical resistance throughout. Specifically, it was found that the connection strength for the brushes sealed with the silane (curve E of FIG. 2), remained substantially constant over the test period. The millivolt drop measurement (FIG. 3) indicated a change from an initial value of 50 MV to a final value of 30 MV. These are regarded as superior characteristics in that the final strength is high, equal indeed to Composition Y with the polyaryl sulfone/solvent; and further, the final millivolt drop is low, being equal to or less than that of any other of the test systems. Accordingly, the Composition Y is seen to be superior for high temperature applications and when utilized with the silane sealant provides in the resultant product a durable, high strength, low resistance shunt connection, exhibiting a very low probability of service failure.

While the present invention has been particularly set forth in terms of specific embodiments thereof, it will be understood in view of the present disclosure that numerous variations upon the invention are now enabled to those skilled in the art, which variations yet reside within the scope of the present teaching. Accordingly, the invention is to be broadly construed and limited only by the scope and spirit of the claims now appended hereto.

We claim:

1. A tamping material for securing electrical connections to carbon blocks comprising free-flowing granules each consisting essentially of 85% to 97% by weight graphite particles and 15% to 3% by weight of polyaryl sulfone resin as a binder.

2. A tamping material according to claim 1 wherein the size of said granules is in the range −20 mesh to +115 mesh.

3. A tamping material according to claim 1 wherein the size of said granules is in the range −20 mesh to +115 mesh.

4. In combination, a carbon block having a cavity formed therein, an electrical conductor having an end portion disposed in said cavity, and a body of conductive granules tamped between said portion of the conductor and the cavity wall and sealed with a polymerized sealant, said conductive granules consisting essentially of 85% to 97% by weight of graphite particles and 15% to 3% by weight of polyaryl sulfone resin as a binder.

5. A combination according to claim 4 in which the conductive granules tamped between the conductor and the cavity wall are sealed with N-(2-aminoethyl)-3-aminopropyltrimethoxysilane.

* * * * *

UNITED STATES PATENT AND TRADEMARK OFFICE

CERTIFICATE OF CORRECTION

PATENT NO. : 4,075,524
DATED : February 21, 1978
INVENTOR(S) : E.F. Bradshaw and J.F. Rakszawski It is certified that error appears in the above-identified patent and that said Letters Patent are hereby corrected as shown below:

The claims, in their entirety, should read as follows:

1. A tamping material for securing electrical connections to carbon blocks comprising free-flowing granules each consisting essentially of 85% to 97% by weight graphite particles and 15% to 3% by weight of polyaryl sulfone resin as a binder.

2. A tamping material according to claim 1 wherein the size of said granules is in the range -20 mesh to +115 mesh.

3. In combination, a carbon block having a cavity formed therein, an electrical conductor having an end portion disposed in said cavity, and a body of conductive granules tamped between said portion of the conductor and the cavity wall and sealed with a polymerized sealant, said conductive granules consisting essentially of 85% to 97% by weight of graphite particles and 15% to 3% by weight of polyaryl sulfone resin as a binder.

UNITED STATES PATENT AND TRADEMARK OFFICE

CERTIFICATE OF CORRECTION

PATENT NO. : 4,075,524

DATED : February 21, 1978

INVENTOR(S) : E.F. Bradshaw and J.F. Rakszawski

It is certified that error appears in the above-identified patent and that said Letters Patent are hereby corrected as shown below:

4. In combination, a carbon block having a cavity formed therein, an electrical conductor having an end portion disposed in said cavity, and a body of conductive granules tamped between said portion of the conductor and the cavity wall and sealed with an aminofunctional silane, said conductive granules consisting essentially of 85% to 97% by weight of graphite particles and 15% to 3% by weight of polyaryl sulfone resin as a binder.

5. A combination according to claim 4 in which the conductive granules tamped between the conductor and the cavity wall are sealed with N-(2-aminoethyl)-3-aminopropyltrimethoxysilane.

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*